313-422 SR
8/12/80 XR 4,217,519

United States Patent [19] [11] 4,217,519
Catanese et al. [45] Aug. 12, 1980

[54] ISOLATION BUSBAR FOR A FLAT PANEL DISPLAY DEVICE

[75] Inventors: Carmen A. Catanese, Rocky Hill; Louis S. Cosentino, Belle Mead, both of N.J.

[73] Assignee: RCA Corporation, New York, N.Y.

[21] Appl. No.: 4,178

[22] Filed: Jan. 17, 1979

[51] Int. Cl.[2] ..... H01J 29/52; H01J 29/88; H01J 29/90

[52] U.S. Cl. ..... 313/411; 313/422; 313/460; 313/479

[58] Field of Search ..... 313/422, 479, 477, 460, 313/411

[56] References Cited

U.S. PATENT DOCUMENTS 4,088,920 5/1978 Siekanowicz et al. ..... 313/422
4,128,784 12/1978 Anderson ..... 313/422

*Primary Examiner*—Palmer C. Demeo
*Attorney, Agent, or Firm*—E. M. Whitacre; G. H. Bruestle; V. J. Coughlin, Jr.

[57] ABSTRACT

In a display device having an evacuated envelope, an electron beam guide and an electron generating means for generating beams of electrons, a modulator structure on which is disposed a plurality of control electrodes may be formed by interconnecting selected ones of the control electrodes which operate at a common potential. This interconnected electrode structure decreases the number of control electrodes which extend from the evacuated envelope. The electron generating means is shielded from the interconnected electrode structure to prevent perturbation of the generated electron beams.

6 Claims, 7 Drawing Figures

ISOLATION BUSBAR FOR A FLAT PANEL DISPLAY DEVICE

BACKGROUND OF THE INVENTION

The present invention relates to a flat panel display device and particularly to a display device having electrode interconnecting means and shielding means therefor.

The copending Anderson et al. application, Ser. No. 966,564, filed Dec. 4, 1978, entitled "Modulator Structure for a Flat Panel Display Device," and assigned to the same assignee as this application discloses a plurality of electrode lead-in terminals for modulation and isolation control electrodes within the device. One of the drawbacks of the Anderson et al. structure is that it requires an individual connection to each isolation electrode lead-in terminal even though these electrodes are all held at a common, static voltage. Applicants' novel structure reduces the total external control electrode connections, thus improving the reliability of the device by reducing the number of vacuum feedthroughs and decreasing the number of independent isolation electrodes. Applicants' novel structure also provides a shielding means for preventing perturbation of the electron beams.

SUMMARY OF THE INVENTION

A display device includes an evacuated envelope containing means for generating and injecting beams of electrons into an electron beam guide. A modulator structure includes a separate pair of control electrodes which partially overlap the beam guide. Interconnecting means for biasing selected ones of the control electrodes which operate at a common potential decreases the number of lead-in terminals through the evacuated envelope. A shielding means for attenuating the electric field emanating from the interconnecting means prevents perturbation of the electron beams generated by the electron generating means.

DETAILED DESCRIPTION OF THE PREFERRED EMBODIMENT

Figure 1:
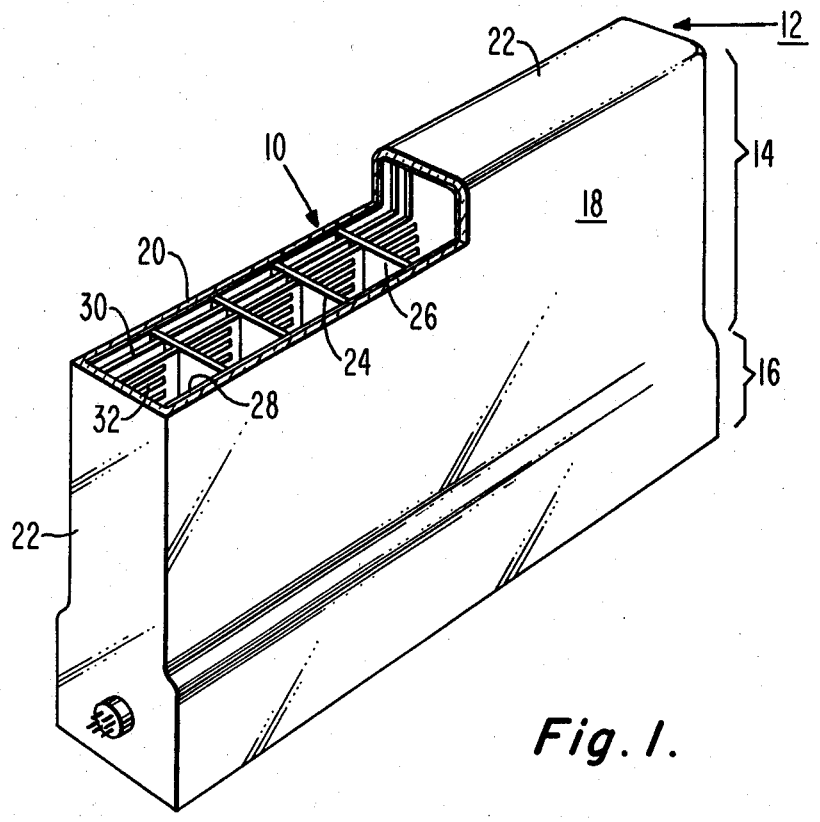
FIG. 1 is a perspective view, partially broken away, of a flat display device into which the present invention can be incorporated.

Referring to FIGS. 1-4, one form of a flat display device of the present invention is generally designated as 10. The display device 10 comprises an evacuated envelope 12, typically of glass, having a display section 14 and an electron gun section 16. The envelope 12 includes a rectangular front wall 18 and a rectangular back wall 20 in spaced parallel relation with the front wall 18. The front wall 18 and the back wall 20 are connected by four side walls 22.

A plurality of spaced, parallel support walls 24, are secured between the front wall 18 and the back wall 20 and extend from the gun section 16 to the opposite side wall 22. The support walls 24 provide the desired internal support against external atmospheric pressure and divide the display section 14 into a plurality of channels 26. On the inner surface of the front wall 18 is a screen 28 composed of cathodoluminescent elements which may be of any well known type presently used in cathode ray tubes. In a color display, for example, the phosphor screen in each of the channels 26 alternates between red, green, and blue light-emitting phosphor strips or elements.

Figure 2:
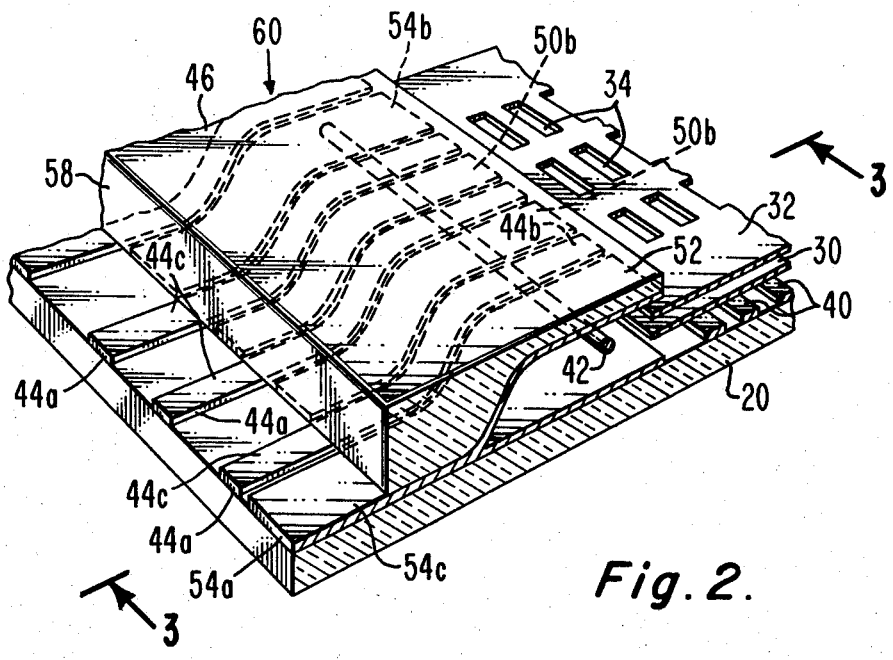
FIG. 2 is a perspective view of a portion of the modulator structure, line cathode and beam guide of the display device of FIG. 1.
Figure 3:
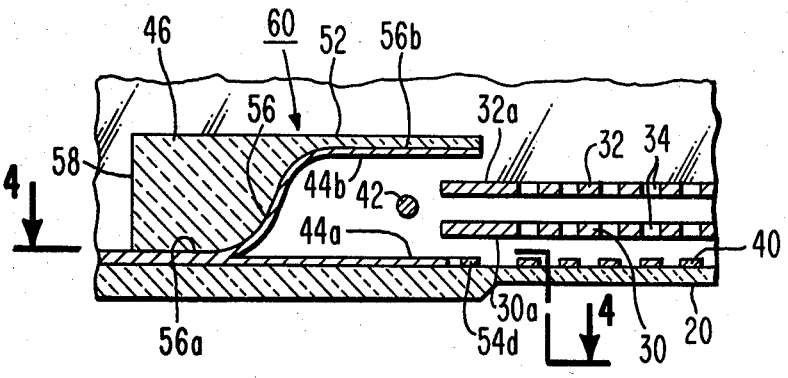
FIG. 3 is a sectional view through a portion of the modulator structure, line cathode, and beam guide taken along line 3—3 of FIG. 2.

In each of the channels 26 is a beam guide assembly of the type described in U.S. Pat. No. 4,088,920 to W. W. Siekanowicz et al., issued May 9, 1978, entitled "Flat Display Device with Beam Guide." As shown in FIGS. 2 and 3, each of the beam guide assemblies includes a pair of spaced, parallel beam guide plates 30 and 32 extending transversely across the channel 26. Although not shown, the guide plates 30 and 32 also extend longitudinally along the channel from the gun section 16 to the opposite side wall 22. The first beam guide plate 30 is adjacent and parallel to the back wall 20 of the envelope 12 and the second beam guide plate 32 is between the first first beam guide plate 30 and the front wall 18. The second beam guide plate 32 has a plurality of apertures 34 therethrough with the apertures being arranged in rows transversely across and longitudinally along the channel 26. The first beam guide plate 30 has similar apertures 34 therethrough with each of the apertures in the first beam guide plate 30 being in alignment with a separate aperture 34 in the second beam guide plate 32. Each pair of longitudinal rows of the apertures in the beam guide plates forms a separate electron beam guide along the channel 26. Each of the guide plates 30 and 32 adjacent the gun section 16 may have the first bar 30*a* and 32*a*, respectively, i.e., the solid section of the plate between the end of the guide and the first transverse row of apertures, increased from a typical longitudinal dimension of 48 mils (1.22 mm) to 72 mils (1.83 mm) for a reason which will be made clear later.

A plurality of spaced, parallel conductors 40 are on the back wall 20. The conductors 40 extend transversely across the channels 26 with each conductor 40 extending along a separate transverse row of the apertures in the beam guide plates 30 and 32. The conductors 40 are strips of an electrically conductive metal, coated on or bonded to the back wall 20.

In the gun section 16 of the envelope 12 is a modulator structure 60 which includes the present novel interconnecting and shielding means. The gun section 16 includes a conventional line cathode 42 of a filament of a metal which will withstand high temperatures, such as tungsten, coated with an emissive material, such as emissive oxides. The cathode 42 extends transversely across the end of the channels 26 and is positioned in a plane which is parallel and between the planes of the beam guide plates 30 and 32. The cathode 42 is held under tension, such as by springs (not shown) at the ends of the cathode. There may be separate cathodes across each of the channels 26, across several of the channels 26, or a single cathode across all of the channels.

Figure 4:
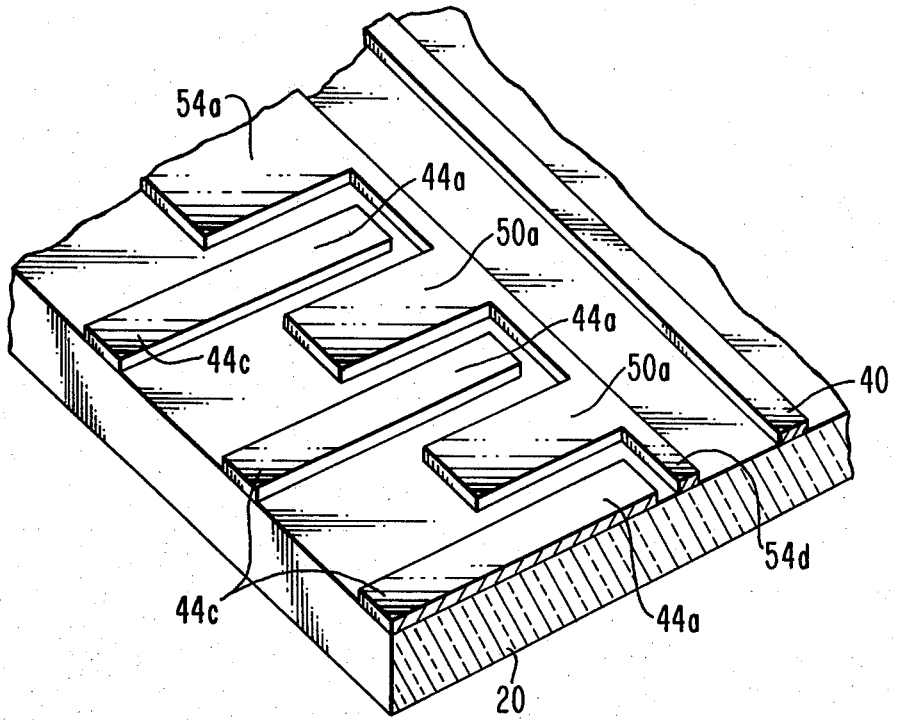
FIG. 4 is a top view of the back wall portion of the modulator structure taken along line 4—4 of FIG. 3.

The modulator structure 60 as shown in FIGS. 2 and 3 includes the back wall 20 of the device on which is disposed a plurality of interleaved first control electrodes. As shown in FIG. 4, the first control electrodes include discrete first modulation electrodes 44*a* and first isolation electrodes 50*a* and 54*a*. The first isolation electrodes 50*a* and 54*a* are interconnected by means of an isolation busbar 54*d* which extends transversely across the ends of the channels 26 (not shown). A first isolation electrode 54*a*, wider than the first isolation electrode 50*a*, may be located at each end of the back wall 20 and between each triplet of first modulation electrodes 44*a* thus providing electrical isolation between adjacent channels 26. The first modulation electrodes 44*a* are parallel to the first isolation electrodes 50*a* and 54*a* and extend from an edge of the back wall 20 toward and perpendicular to the isolation busbar 54*d*. Since only a single isolation electrode 54*a* extends from the evacuated envelope, the other isolation electrodes being internally interconnected, FIG. 2 shows only one lead-in terminal 54*c* of isolation electrode 54*a* extending from an edge of the back wall 20 toward and perpendicular to the isolation busbar 54*d* (not shown). This structure increases the reliability of the device by decreasing the number of electrode lead-in terminals which extend through the evacuated envelope. Both the first modulation electrodes 44*a* and the first isolation electrodes 50*a* and 54*a* extend across the back wall 20 a distance sufficient to partially overlap an end of the beam guide plate 30 without overlapping any apertures 34 in the plate 30. As shown in FIG. 3, the isolation busbar 54*d* also partially overlaps the beam guide plate 30 without overlapping any of the apertures 34 in the plate 30. The isolation busbar 54*d* is shielded from the line cathode 42 by the first bar 30*a* of guide plate 30.

The modulator structure 60 further includes a modulator member 46 similar to the modulator member disclosed in copending U.S. patent application, Ser. No. 966,564, filed Dec. 4, 1978, by C. H. Anderson et al. Anderson et al. disclose a modulator member 46 having a substantially planar surface 52 disposed opposite from a smoothly curved, continuous surface 56 which includes two substantially flat portions 56*a* and 56*b* which lie in spaced apart parallel planes. A plurality of discrete interleaved second control electrodes are disposed on the curved surface 56. The second control electrodes include second isolation electrodes 50*b* and 54*b* and second modulation electrodes 44*b*.

In the present device, as shown in FIG. 2, the second control electrodes 44*b*, 50*b* and 54*b* are also disposed on the curved surface 56 of member 46. Since in a color display device three beams of electrons may be generated and injected into each beam guide within a channel, a triplet of second modulation electrodes 44*b* may be formed having second isolation electrodes 50*b* spaced from and interleaved between the second modulation electrodes 44*b*. Second isolation electrodes 54*b*, wider than second isolation electrodes 50*b*, may be located at each end of surface 56 and between adjacent triplets thus providing electrical isolation between adjacent channels 26.

Typical widths of the various elements are as follows: isolation electrodes 50*b*, 100 mils (2.54 mm); isolation electrode 54*b*, 524 mils (13.31 mm); modulation electrodes 44*b*, 80 mils (2.03 mm); open spacing between adjacent electrodes, 10 mils (0.25 mm). Since the second electrodes 44*b*, 50*b*, and 54*b* on the modulator member 46 are aligned with and form opposing electrode pairs with the corresponding first electrodes 44*a*, 50*a* and 54*a* on the back wall 20, the widths of the first electrodes on the back wall 20 are identical to those of the second electrodes on the curved surface 56 of modulator member 46. The flat portion 56*a* of curved surface 56 comprises a sealing surface which contacts the back wall 20. The flat distal portion 56*b* of curved surface 56 partially overlaps one end of the beam guide plate 32 without overlapping any of the apertures 34 in the plate 32.

The first modulation and isolation electrodes 44*a* and 50*a* and the second modulation and isolation electrodes 44*b* and 50*b* comprise a mixture of vitreous glass frit, binder, and metal particles such as silver which may be sintered to bring about agglomeration of the vitreous glass frit and the metal particles. Sintering is well-known in the art. A commercially available mixture sold under the trademark DuPont 7713 ink may be used for the electrodes. The electrodes may be formed by any number of well-known techniques such as silk-screening or photolithography. The wider isolation electrodes 54*a* and 54*b* comprise the same mixture of vitreous glass frit, binder, and metal particles which may be sintered to bring about agglomeration of the vitreous glass frit and the metal particles as the isolation electrodes 50*a* and 50*b*.

The novel isolation busbars 54*d* on the back wall 20 may be formed in the above-described manner used to form the control electrodes, or by any equivalent process such as coating or bonding electrically conductive strips to the back wall 20. The isolation busbar 54*d* typically has a width of 20 mils (0.51 mm), and is typically spaced from the modulation electrodes 44*a* by about 16 mils (0.41 mm).

As described in the previously referred to Anderson et al. application, in a modulator structure 60, the modulator member 46 may be attached to the back wall 20 by thermally bonding together the vitreous glass frit electrodes so that the first and second modulation electrodes 44*a* and 44*b* and the first and second isolation electrodes 50*a* and 50*b* and 54*a* and 54*b* are aligned and registered to form opposing pairs of electrodes. The spacing between opposing pairs of electrodes is typically 102±0.5 mils (about 2.59±0.013 mm). Since the second modulation and isolation electrodes 44*b*, 50*b* and 54*b* extend across the smoothly curved, continuous surface 56 of the modulator member 46, electrical connection is established between the first and second modulation electrodes 44*a* and 44b and between the first and second isolation electrodes 50*a* and 50*b*, and 54*a* and 54*b* at the interface between the sealing surface 56*a* of the modulator member 46 and the back wall 20. The present modulator structure 60 provides a single electrode lead-in terminal 44*c* for each opposing pair of modulator electrodes 44*a* and 44*b* and a single electrode lead-in terminal 54*c* for all of the interconnected opposing pairs of isolation electrodes 50*a* and 50*b*, and 54*a* and 54*b*. As shown in FIG. 2, the electrode terminals 44*c* and 54*c* which are disposed on the back wall 20 between surface 58 of the modulator member 46 and the edge of the back wall 20 are continuations of the electrodes 44*a* and 54*a*.

In the operation of the display device 10, a high positive potential, typically about +300 volts, is applied to each of the conductors 40, and a low positive potential typically about +80 volts is applied to the beam guide plates 30 and 32. A very high positive potential, typically about 8–10 kV is applied to the phosphor screen 28. These potentials are with regard to the potential applied to the cathode 42. As described in the Siekanowicz et al. patent, the potential differences between the beam guide plate 30 and the conductors 40, and between the beam guide plate 32 and the phosphor screen 28 create electrostatic fields which extend into the space between the beam guide plates 30 and 32 and confine electrons into beams flowing between the beam guide plates along each of the longitudinal rows of the apertures 34. The beams of electrons can be selectively deflected toward the phosphor screen 28 at selected points along the channels 26 by switching the potential applied to each of the conductors 40 to a negative potential, such as −100 volts. This will cause the beams to be deflected away from the negative conductor so that the beams will pass through the adjacent apertures 34 in the beam guide plate 32. The beams will then impinge on the phosphor screen 28 to provide a line scan of the phosphor screen.

The electron beams are generated in the gun section 16 by heating the cathode to its emission temperature, typically about 760° C., to cause the cathode to emit electrons. With a potential applied to the modulation electrodes **44*a* and 44*b* sufficiently negative with respect to the potential applied to the cathode 42, typically about 70 volts more negative, the electrons emitted from the cathode will be trapped within the gun structure. When the potential applied to any pair of the modulation electrodes 44*a* and 44*b* is switched to a less negative potential, typically about 10 volts negative with respect to the cathode, the electrons in the region of such modulation electrodes will flow toward the positively charged beam guide plates 30 and 32 in the form of a beam. The first modulation electrodes 44*a* may be adjacent first isolation electrodes 50*a* or between first isolation electrodes 50*a* and 54*a* while the second modulation electrodes 44*b* may be between adjacent second isolation electrodes 50*b* or between second isolation electrodes 50*b* and 54*b* depending upon the location of the modulation electrodes with respect to the channel. The control electrodes 44*a*, 44*b*, 50*a*, 50*b*, 54*a* and 54*b* extend over the edge of the guide plates 30 and 32 without overlapping the apertures 34 in plates 30 and 32. The isolation electrodes 50*a* and 50*b*, and 54*a* and 54*b*, are negatively biased with respect to the cathode, e.g., −100 volts d.c., thereby interspersing negative potential barrier regions along the cathode length. Since all the isolation electrodes 50*a*, 50*b*, 54*a* and 54*b* are held at a common potential, the reliability of the device may be increased by internally connecting the first isolation electrodes 50*a* and 54*a* by means of isolation busbar 54*d*, thus requiring only a single electrode lead-in terminal extending from the evacuated device for the negative isolation potential. This negative isolation potential superposes with the potential which circumscribes the cathode so that the net field intensity alternates in polarity along the length of the cathode. These alternating segments of field intensity along the length of the cathode 42** serve to form beamlets of electrons which can be independently modulated.

Since the cathode 42 is shielded from the isolation busbar **54*d* by first bar 30*a* of guide plate 30, the negative potential on busbar 54*d* has no deleterious effect on the electron beam trajectories from cathode 42 provided the width of the first bars 30*a* and 32*a* on guide plates 30 and 32, respectively, is increased from a typical longitudinal dimension of 48 mils (1.22 mm) to 72 mils (1.83 mm). The first bar 30*a* on guide plate 30 is thus able to conceal both a relatively wide, e.g., 20 mils, isolation busbar 54*d*** and the edges of the control electrodes.

Figure 5:
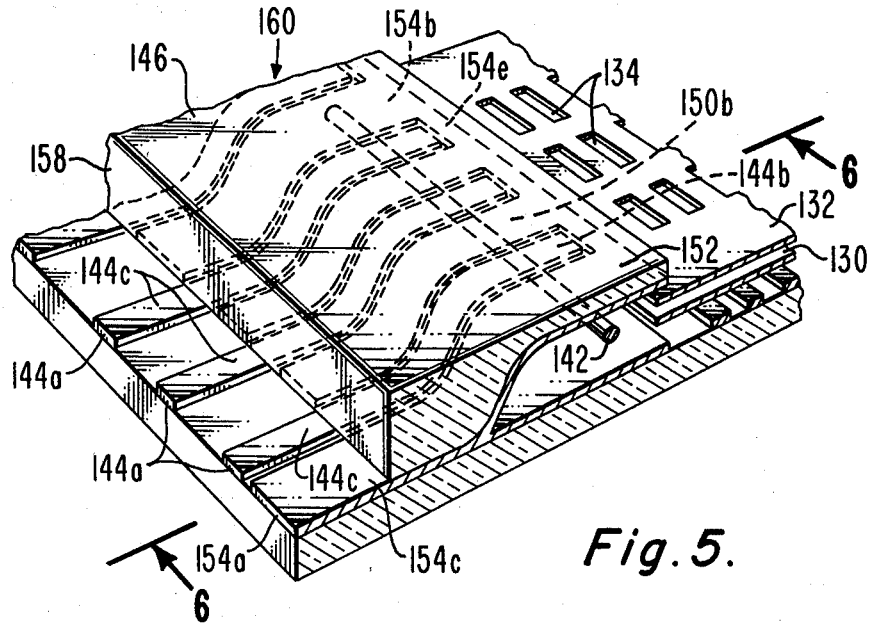
FIG. 5 is a perspective view of another embodiment of modulator structure, line cathode and beam guide.
Figure 6:
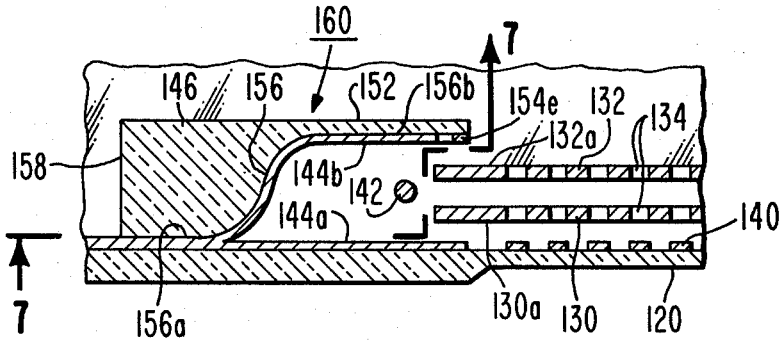
FIG. 6 is a sectional view through a portion of the modulator structure, line cathode and beam guide taken along line 6—6 of FIG. 5.
Figure 7:
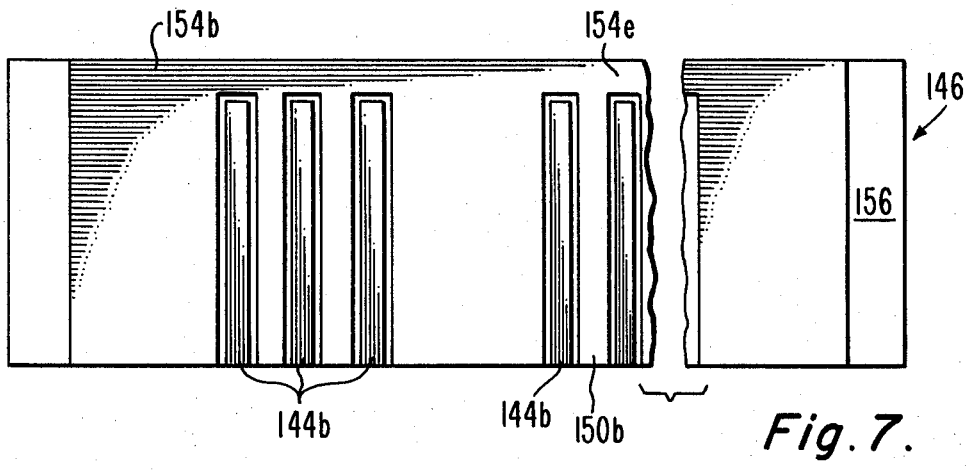
FIG. 7 is a bottom view of the modulator member showing the electrode pattern taken along line 7—7 of FIG. 6.

FIGS. 5–7 show a modulator structure 160 having a different control electrode pattern. In this embodiment, the modulator structure 160 is substantially identical to the modulator structure 60 discussed above except that the isolation busbar **154*e* connects second isolation electrodes 150*b* and 154*b* on modulator member 146. A sectional view of modulator structure 160 is shown in FIG. 6. It is clear from FIG. 6 that cathode 142 is shielded from isolation busbar 154*e* on modulator member 146 by the first bars 132*a* of guide plate 132 so that a negative potential on busbar 154*e* does not produce a deleterious effect on the electron beam trajectories from cathode 142. This shielding occurs by increasing the width of the first bars 130*a* and 132*a* on guide plates 130 and 132, respectively, from a typical longitudinal dimension of 48 mils (1.22 mm) to 72 mils (1.83 mm). The first bar 132*a* on guide plate 132 is thus able to conceal both the isolation busbar 154*e* and the edges of the control electrodes. FIG. 7 is a bottom view of the electrode pattern on the surface 156 of modulator member 146. The dimensions of the electrodes shown in FIG. 7 are substantially equal to the equivalent electrodes discussed above for modulator member 46 of modulator structure 60. In FIG. 7, which is not to scale, the width of the isolation busbar 154*e* which extends along the top edge of FIG. 7** is typically 20 *mils* (0.51 mm).

We claim:

1. In a display device having an evacuated envelope with substantially parallel front and back walls, an electron beam guide comprising a pair of guide plates, each of said guide plates having a plurality of apertures therethrough, a modulator structure including in combination a modulator member and said back wall, said modulator structure having a plurality of control electrodes forming opposing pairs of electrodes thereon, said electrodes partially overlapping said beam guide without overlapping said apertures, an electron generating means for generating beams of electrons extending between said opposing pairs of electrodes across one end of said beam guide, and a cathodoluminescent screen on the front wall, the improvement comprising, interconnecting means for biasing selected ones of said control electrodes which operate at a common potential, thereby decreasing the number of control electrodes which extend from said evacuated envelope, and shielding means for attenuating the electric field emanating from said interconnecting means thereby preventing perturbation of the electron beams generated by the electron generating means.

2. A display device in accordance with claim 1 wherein the control electrodes which are bused further comprise isolation electrodes.

3. A display device in accordance with claim 2 wherein at least one isolation electrode extends from said evacuated envelope.

4. A display device in accordance with claim 2 wherein the interconnecting means includes an isolation busbar disposed on said modulator structure.

5. A display device in accordance with claim 4 wherein the isolation busbar partially overlaps said beam guide without overlapping any of said apertures, said busbar being substantially parallel to but non-coplanar with said line cathode.

6. A display device in accordance with claim 5 wherein said shielding means includes a first bar section on each of said guide plates for shielding said electron beams from said isolation busbar.

* * * * *